US007333914B1

(12) United States Patent
Iachini

(10) Patent No.: US 7,333,914 B1
(45) Date of Patent: Feb. 19, 2008

(54) TWO-WAY MOTION SENSOR METER FOR MEASURING ARM EXERCISE

(76) Inventor: Janette L. Iachini, 2147 SE. Lois St., Roseburg, OR (US) 97470

( * ) Notice: Subject to any disclaimer, the term of this patent is extended or adjusted under 35 U.S.C. 154(b) by 0 days.

(21) Appl. No.: 11/392,142

(22) Filed: Mar. 28, 2006

Related U.S. Application Data

(60) Provisional application No. 60/668,301, filed on Apr. 4, 2005.

(51) Int. Cl.
*G01B 5/02* (2006.01)

(52) U.S. Cl. ..... 702/160; 235/105

(58) Field of Classification Search ..... 235/105; 702/160

See application file for complete search history.

(56) References Cited

U.S. PATENT DOCUMENTS 4,460,823 A 7/1984 Ruehlemann
4,846,459 A 7/1989 Vivian
5,117,444 A 5/1992 Sutton et al.
2006/0122521 A1* 6/2006 Chen ..... 600/503

* cited by examiner

*Primary Examiner*—John Barlow
*Assistant Examiner*—Stephen J Cherry
(74) *Attorney, Agent, or Firm*—Robert E. Howard

(57) ABSTRACT

A two-way motion sensor meter for measuring arm exercise. The meter is mounted on a wrist band adapted to be affixed to a user's wrist. The meter includes numeric display means driven by an electronic or mechanical system. The electronic or mechanical system includes first and second pendulums. The first pendulum is adapted to swing about an axis in a plane substantially parallel to a user's body. The second pendulum is adapted to swing about an axis in a plane substantially perpendicular to a user's body. Each pendulum is adapted to send a signal to the numeric display means each time it is caused to swing by movement of the user's arm upwardly and/or downwardly during exercise. The numeric display means is adapted to add each signal to provide a display of the total number of signals.

3 Claims, 2 Drawing Sheets

TWO-WAY MOTION SENSOR METER FOR MEASURING ARM EXERCISE

CROSS-REFERENCE TO RELATED APPLICATIONS

This application claims the benefit of U.S. Provisional Application No. 60/668,301 filed Apr. 4, 2005.

BACKGROUND OF THE INVENTION

The present invention relates to a two-way motion sensor meter for measuring arm exercise.

It has long been known to measure the distance traveled by runners, joggers or walkers using a device called a pedometer. Such devices use a swinging pendulum to advance a distance indicator meter. The pendulum can actuate the meter by mechanical or electrical means. Such devices are typically clipped to the belt of the user, or strapped around the user's waist or hips.

Many upper body exercises employ arm motion. During a typical such exercise session the right and left arms are swung in right and left planes substantially parallel to the user's body (an exaggeration of right and left arm motion during walking or running), or in a common plane substantially perpendicular to the user's body (where the arms are swung from the user's side away from the user's body and up to a position adjacent the user's head). It would be useful to be able to measure the number of times the exerciser's arms move in both directions during an exercise period in order to assess the extent of the exercise.

SUMMARY OF THE INVENTION

It is an object of the present invention to provide a motion sensor for measuring the extent of arm exercise both in the plane parallel to the user's body and in the plane perpendicular to the user's body.

The two-way motion sensor meter of the present invention is mounted on a wrist band adapted to be affixed to a user's wrist. The meter includes numeric display means driven by an electronic or mechanical system. The electronic or mechanical system includes first and second pendulums. The first pendulum is adapted to swing about an axis in a plane substantially parallel to a user's body. The second pendulum is adapted to swing about an axis in a plane substantially perpendicular to a user's body.

Each pendulum is adapted to send a signal to the numeric display means each time it is caused to swing by movement of the user's arm upwardly or downwardly during exercise.

The numeric display means is adapted to add each signal to provide a display of the total number of signals received during an exercise session. The numeric display can be reset to zero.

DESCRIPTION OF PREFERRED EMBODIMENTS

Figure 2:
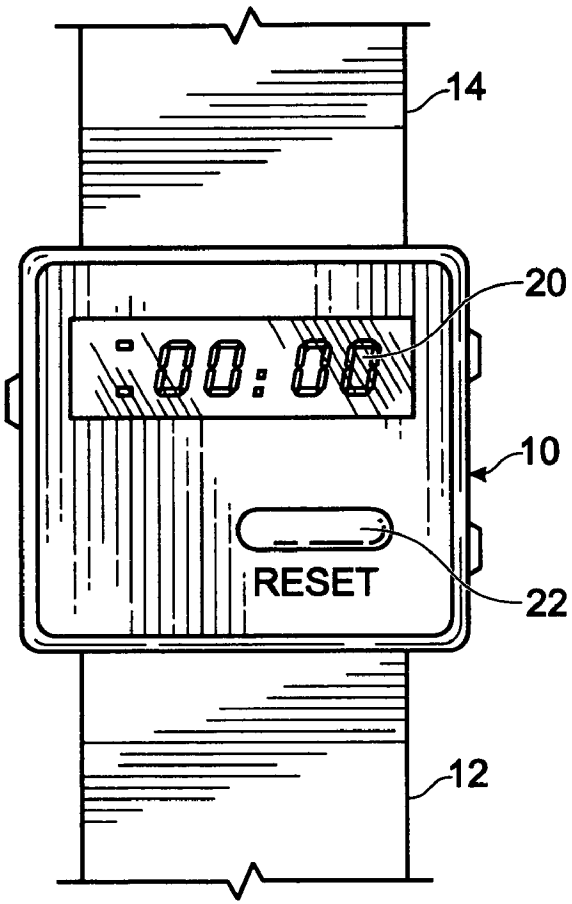
FIG. 2 is a top elevation view of the meter.
Figure 1:
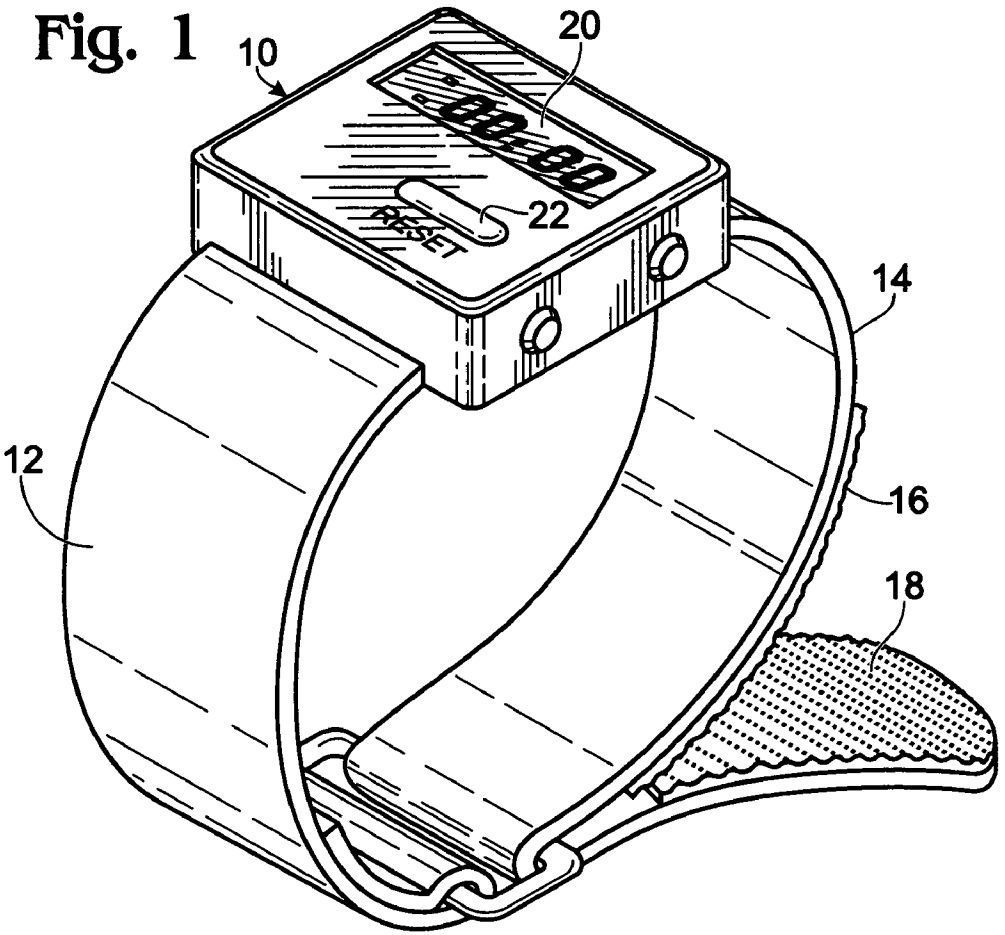
FIG. 1 is a perspective view of the two-way motion sensor meter of the present invention mounted on a wrist band.

The two way motion sensor meter 10 is attached to wrist band straps 12 and 14. Strap 14 has hook and loop fastener portions 16 and 18 which can be used to firmly hold the meter 10 on a user's wrist.

The outer face of meter 10 has an LCD display 20 and a reset button 22.

Figure 3:
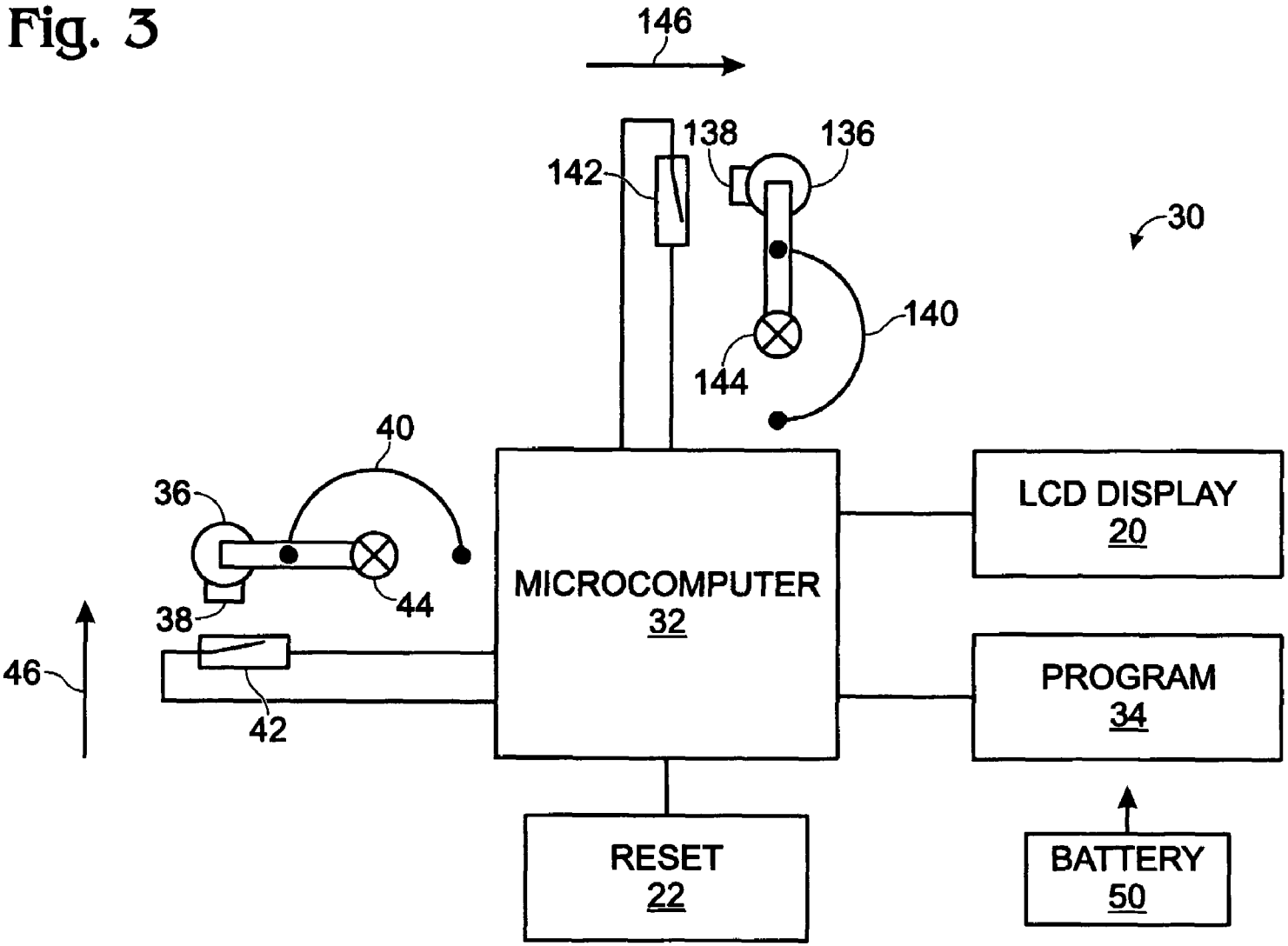
FIG. 3 is a block diagram of the electronic circuitry of the meter.

A block diagram of the electronic system 30 contained within meter 10 is shown in FIG. 3. The system 30 includes a microcomputer 32 and a program 34.

A first weighted pendulum 36 has a first magnet 38, a first balance spring 40, and a first reed switch 42. First pendulum 36 swings about a first axis 44 which, during arm movement in a plane substantially parallel to the user's body in the direction shown by arrow 46, causes first magnet 38 to come into close proximity to first reed switch 42, thereby causing electrical contacts within reed switch 42 to touch and close a first electrical circuit. Closing the first electrical circuit causes first microcomputer 32 to send a signal to LCD display 20 to register one arm movement. The first pendulum 36 can be adapted to swing either during an upswing or downswing motion of the user's arm. Each time the user's arm is moved in a plane parallel to the user's body, first microcomputer 32 adds another arm movement to the total displayed on the LCD display 20.

A second weighted pendulum 136 has a second magnet 138, a second balance spring 140, and a second reed switch 142. Second pendulum 136 swings about a second axis 144 which, during arm movement in a plane substantially perpendicular to the user's body in the direction shown by arrow 146, causes second magnet 138 to come into close proximity to second reed switch 142, thereby causing electrical contacts within second reed switch 142 to touch and close a second electrical circuit. Closing the second electrical circuit causes microcomputer 32 to send a signal to LCD display 20 to register one arm movement. The second pendulum 136 can be adapted to swing either during an upswing or downswing motion of the user's arm. Each time the user's arm is moved in a plane perpendicular to the user's body, microcomputer 32 adds another arm movement to the total displayed on the LCD display 20. The number of perpendicular arm movements can either be added to the number of parallel arm movements, or kept track of separately with a second LCD display (not shown).

Microcomputer 32 can be programmed to only register one arm movement in the event the user moves his or her arm in a direction that triggers both first and second electrical circuits.

A battery 50 powers electronic system 30.

Instead of using an electronic meter using a pair of reed switches, a mechanical meter using a pair of pivoted pendulums which drives a mechanical digital counter or counters via gear trains and ratchet wheels may be used. A single such pivoted pendulum and associated gear train and ratchet wheel system is described in U.S. Pat. No. 4,460,823, the entire contents of which are hereby incorporated by reference.

It will be obvious to those having skill in the art that many changes may be made to the details of the above-described embodiments of this invention without departing from the underlying principles thereof. The scope of the present invention should, therefore, be determined only by the following claims.

The invention claimed is:

1. A two-way motion sensor meter for measuring arm exercise comprising:

a meter mounted on a wrist band adapted to be affixed to a user's wrist;

said meter including numeric display means driven by an electronic circuit including a microcomputer and a power source, said electronic circuit including first and second weighted pendulums adapted to swing about an axis, said first weighted pendulum adapted to swing about an axis in a plane substantially parallel to a user's body, said second weighted pendulum adapted to swing about an axis in a plane substantially perpendicular to a user's body, said electronic circuit being open when the user's arm is not in motion and closed when said user's arm swings in one of said upwardly or downwardly motions, each of said first and second weighted pendulums adapted to send a signal to said numeric display means each time a user swings an arm in one of an upwardly or downwardly motion during exercise, said numeric display means adapted to add each said signal to provide a display of the total number of signals.

2. The two-say motion sensor meter of claim 1 wherein said electronic circuit includes first and second magnets attached to said first and second pendulums, respectively, and first and second switch means adapted to be closed upon movement of said first and second magnets into close proximity of said first and second switch means, respectively, and opened upon movement of said first and second magnets away from close proximity thereto.

3. The two-say motion sensor meter of claim 2 wherein said first and second switch means each are reed switches.

* * * * *